US006058771A

United States Patent [19]

Johnson et al.

[11] Patent Number: 6,058,771

[45] Date of Patent: May 9, 2000

[54] DETERMINATION OF FLUID INFLUX OR EFFLUX

[75] Inventors: Ashley Bernard Johnson, Milton, United Kingdom; Iain Rezmer-Cooper, Sugar Land, Tex.

[73] Assignee: Schlumberger Technology Corporation, Sugar Land, Tex.

[21] Appl. No.: 09/101,866

[22] PCT Filed: Jan. 24, 1997

[86] PCT No.: PCT/GB97/00200

§ 371 Date: Feb. 1, 1999

§ 102(e) Date: Feb. 1, 1999

[87] PCT Pub. No.: WO97/27381

PCT Pub. Date: Jul. 31, 1997

[30] Foreign Application Priority Data

Jan. 24, 1996 [GB] United Kingdom ..... 9601362

[51] Int. Cl.[7] ..... F21B 21/08; F21B 47/10

[52] U.S. Cl. ..... 73/152.21; 73/152.22; 73/152.29

[58] Field of Search ..... 73/152.21, 152.22, 73/152.29, 152.31, 152.38, 152.51, 152.52, 152.55, 64.41; 166/250.02

[56] References Cited

U.S. PATENT DOCUMENTS

| | | | |
|---|---|---|---|
| 4,274,283 | 6/1981 | Maus et al. | 73/152.52 |
| 4,299,123 | 11/1981 | Dowdy | 73/152.22 |
| 5,042,296 | 8/1991 | Burgess | 73/152.31 |
| 5,184,508 | 2/1993 | Desbrandes | 73/152.52 |
| 5,247,830 | 9/1993 | Goode | 73/152.51 |
| 5,465,609 | 11/1995 | Romieu et al. | 73/64.41 |

*Primary Examiner*—Hezron Williams
*Assistant Examiner*—Chad Soliz
*Attorney, Agent, or Firm*—Steven L. Christian; Wayne Kanak

[57] ABSTRACT

When drilling a borehole for an oil well it is desirable to know when fluid is passing through the walls of the borehole between the borehole itself and the formation through which the borehole is passing. It has now been discovered that useful information about the influx or efflux of fluid can be gained by observing the pressure within the borehole in the region of the drilling bit, this observation being carried out not when the drill is actually operating but when it is still (and the pipe string to which it is mounted is also still) and the drilling fluid is not being pumped; the basis for this is that the drilling fluid is thixotropic, and when not disturbed will form a gel which is capable of quite accurately transmitting the force created by moving fluids at the interface between the borehole and the earth formation being drilled through—that is inflowing or outflowing fluids—displacing the drilling fluid along the borehole, and with an efficiency far greater than previously recognized. It is this which is the present invention—a method of, and apparatus for, determining fluid inflow or outflow during drilling, by using a gelling drilling fluid whose characteristics—yield stress and gelation period—are known, and then, while all drilling and pumping is ceased, measuring downhole differential pressure and using the observed changes therein to allow a determination of the fluid flow.

8 Claims, 4 Drawing Sheets

DETERMINATION OF FLUID INFLUX OR EFFLUX

This invention relates to the determination of fluid influx or efflux to or from a borehole during a drilling operation.

When drilling a borehole for a well, such as an oil or gas well, it is desirable to be informed when fluid is passing through the walls of the borehole between the borehole itself and the formation through which the borehole is passing. Whether a formation fluid, such as water, oil or gas is leaking/flowing out of the formation into the borehole, or drilling fluid (mud) within the borehole is being lost into the formation, it is necessary to know this in order to continue the drilling process properly and efficiently.

It has now been discovered that in certain circumstances useful information about the influx or efflux of fluid can be gained by observing the pressure within the borehole in the region of the drilling bit, this observation being carried out not when the drill is actually operating but when it is still (and the pipe string to which it is mounted is also still) and the drilling fluid is not being pumped; the basis for this is that the drilling fluid is thixotropic (like a non-drip paint), and when allowed to—when not disturbed—will form a gel, as is now explained.

Rather surprisingly it has been found that a gelled drilling fluid is capable of quite accurately transmitting the force created by moving fluids at the interface between the borehole and the earth formation being drilled through—that is, inflowing or outflowing fluids—displacing the drilling fluid along the borehole, and with an efficiency far greater than previously recognised. If the drilling fluid is effectively gelled, it acts like a solid in transmitting pressure, and can therefore respond to and transmit pressure changes due to volume changes occurring near the drill bit with great sensitivity, even if the relevant pressure sensors are themselves located some distance away. During the transition period from the non-gelled to the fully-gelled state pressure changes will increase to those achieved in the fully-gelled state. To use this capability the drilling fluid must actually be allowed to gel and that means that the drill must not be operating, the drill string must not be moving, and the drilling fluid must not be being pumped along the borehole. It is this which is the invention—it is primarily a method of determining fluid inflow or outflow during drilling, by using a gelling drilling fluid whose characteristics yield stress $\tau_y$ and gelation period $t_g$—are known, and then, while all drilling and pumping is ceased, measuring downhole differential pressure $\Delta P$ and using the observed changes therein to allow a determination of the fluid flow.

In one aspect, therefore, the invention provides a method of determining fluid flow into or out of a borehole during drilling of the borehole using a gelling drilling fluid, the method being characterised by including the steps of:

determining the yield stress $\tau_y$ and gelation period $t_g$ of the drilling fluid;

stopping drilling, rotation and pumping, and, while keeping the drilling string stationary for a period of time $t_g$, measuring the downhole differential pressure $\Delta P$ between two points spaced along the longitudinal axial orientation of the borehole; and from a knowledge of the yield stress $\tau_y$ and from the observed changes in differential pressure $\Delta P$ during the gelation period $t_g$, determining the fluid flow.

In a second aspect the invention provides apparatus for use in the method of the invention, which apparatus, comprises:

a bottom hole assembly for drilling a borehole;

a differential pressure monitor, affixed to the bottom hole assembly and operative to measure the differential pressure of fluid in the borehole along the longitudinal axial orientation of the borehole; and means for communicating the output of the differential pressure monitor to the surface.

The preferred forms of both the method and the apparatus of the invention will be seen from the following comments.

The apparatus employs a differential pressure monitor; this is conveniently two individual pressure sensors located on the exterior of the bottom hole assembly and suitably spaced apart from each other along the axial orientation of the borehole (preferably by a distance greater than one foot [about 30 cm]). The pressure monitor (its individual sensors) is desirably positioned near the bottom end of the bottom hole assembly.

Where individual pressure sensors are used in the pressure monitor they advantageously each comprise a quartz pressure sensor having a resolution of at least 0.01 psi (60 Pa) and a range of on the order of 20 thousand psi (130 MPa) (conveniently from 0 to 20 k).

The data gathered by the pressure monitor is best recorded for subsequent use in whatever determination calculations are to be carried out, and rather than transmit the data directly up the string and to some suitable ground surface equipment, most preferably it is stored within the bottom hole assembly. It may then either be utilised there (by appropriate calculating means), or sent up to the surface.

Once gathered, and stored, the pressure monitor's data can be input to means for determining, responsive to the output of the differential pressure monitor, the borehole fluid influx or efflux. This means includes means for determining the change in the measured differential pressure of the gelled drilling fluid in the borehole over a period of time at least equal to the gelling time $t_g$ of the fluid.

The determination of the relevant fluid flow involves a number of factors. Firstly, it requires a knowledge of the drilling fluid characteristics (which may be measured, either in advance or during the drilling process) to allow a determination of the yield stress $\tau_y$ over the gelation time $t_g$ of the fluid. A Fann rheomoter may be used for this purpose. The measured values of $\tau_y$ as a function of time are compared to an equation of the form $$A=\tau_y/t_g \tag{1}$$

(where A and n are constants, and t is time) using a fitting program such as one based on least square fit, to extract the values of the constants A and n.

A period of time $t_g$ is needed for gelation to occur, and this is typically about several seconds to several minutes depending on the type of drilling fluid used as well as on the downhole temperature and pressure conditions. During this period $t_g$, the differential pressure downhole is measured using the pressure sensors P1 and P2. If the differential pressure $\Delta P$ is constant during the period $t_g$ it is determined that there is no influx taking place. If, however, the differential pressure $\Delta P$ is changing then that indicates that fluid flow is occurring—an increasing differential pressure shows that an influx of formation fluids into the borehole is taking place, while a decreasing differential pressure shows that a reverse-influx (that is, an efflux) of drilling fluids into the formation is occurring. The detection of an influx condition can be utilised to trigger an alarm at the surface, prompting the driller to take any required remedial action.

It is optionally possible to determine the influx flow rate q using the following relationship:

$$q=\Delta P/KAt^{n+1} \quad (2)$$

$$K=(96*L)/[(d_o-d_i)^2.(d_o^2-d_i^2)] \quad (3)$$

(where L is the distance between the two pressure sensors, $d_o$ is the diameter of the borehole, and $d_i$ is the diameter of the bottom hole assembly).

As has been noted hereinbefore, in order to promote the gelation of the drilling fluid, all motion of the bottom hole assembly is stopped, by stopping drilling, stopping rotation of the drill string, and stopping pumping of the drilling fluid. Normally, this is done at every change of a stand of drill pipe, and the entire drill string is also lifted off bottom. However, the method of the present invention can be performed more frequently, and at any time that it is desired to detect whether an influx is occurring.

Embodiments of the invention are now described, though by way of illustration only, with reference to the accompanying diagrammatic Drawings in which.

Figure 1:
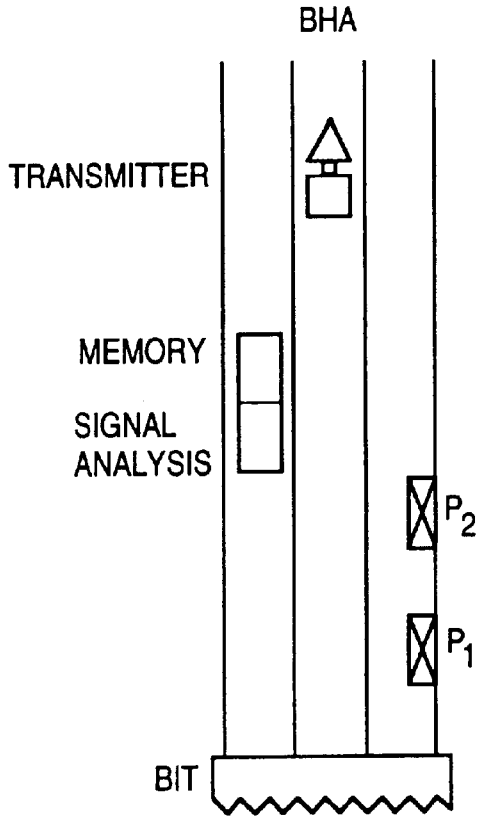
FIG. 1 shows a side see-through view of a bottom hole assembly incorporating the apparatus of the invention.

In the preferred form of the invention's apparatus as shown in FIG. 1 a bottom hole assembly (BHA) for a drilling apparatus is provided, with a differential pressure measuring system built-in. This pressure measurement system comprises two pressure sensors P1 and P2, spaced apart along the longitudinal direction of the BHA. The pressure sensors are quartz pressure sensors having a range of 0–20,000 psi (130 MPa) and a resolution of 0.01 psi (60 Pa).

Figure 2:
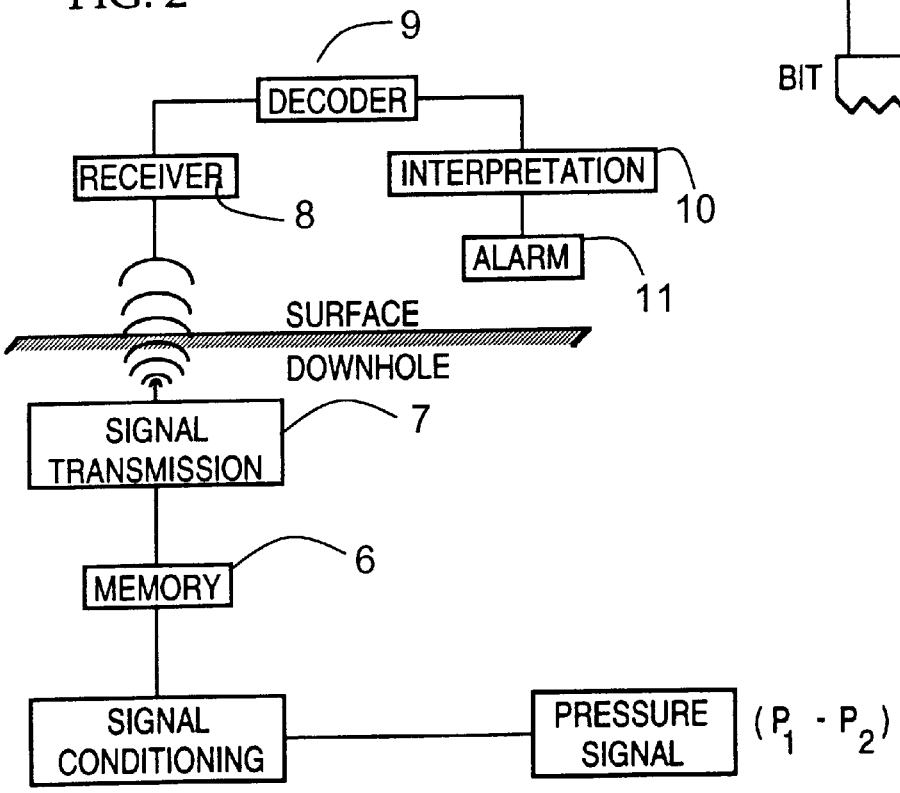
FIG. 2 shows a representation of the sequence of events that might occur using the apparatus and method of the invention.

As can be seen from FIG. 2, in operation the pressure measurement is conditioned in a signal conditioning unit, and then stored in a downhole memory 6. The signals may then be transmitted uphole using signal transmission unit 7, either immediately or—and preferably—at a later time in a delayed-transmit mode of operation. The signals are received by a surface receiver 8, passed through a decoder 9, and processed in an interpretation unit 10 and alarm unit 11.

Figure 3:
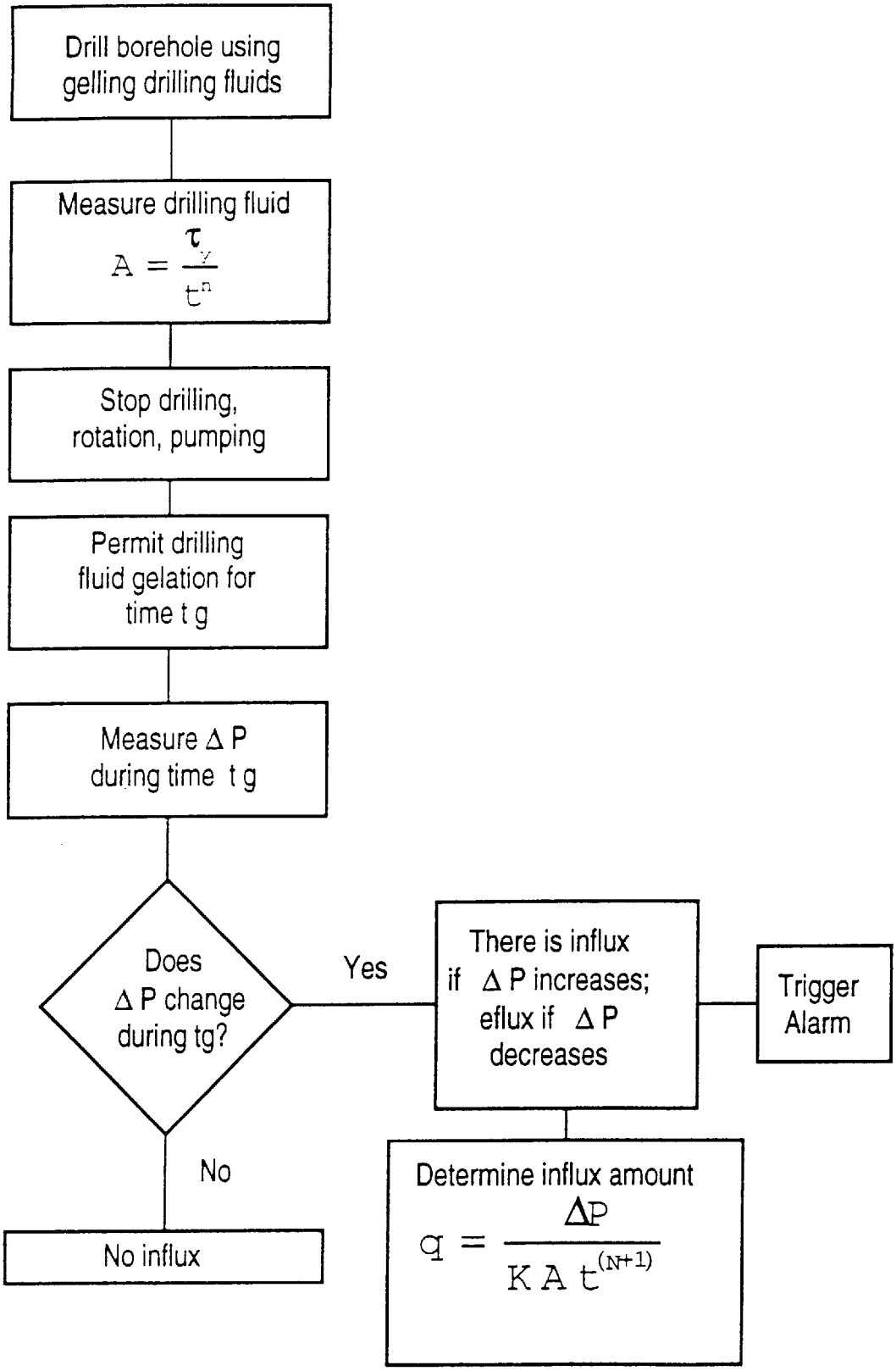
FIG. 3 shows a Flow Diagram setting out the stages of the method of the invention.

FIGS. 3–6 relate to utilising the apparatus during the drilling of a borehole using a gelling drilling fluid. FIG. 3—the logic flow diagram—speaks for itself.

Figure 5:
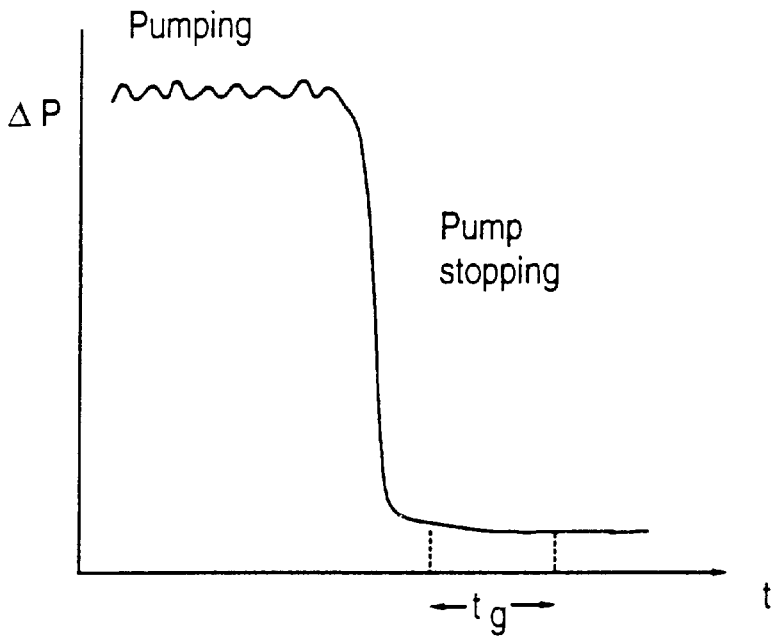
FIGS. 4–7 are graphs showing details of pressures to be seen under appropriate circumstances, and how the data can be fitted to a curve to reveal certain constants.
Figure 4:
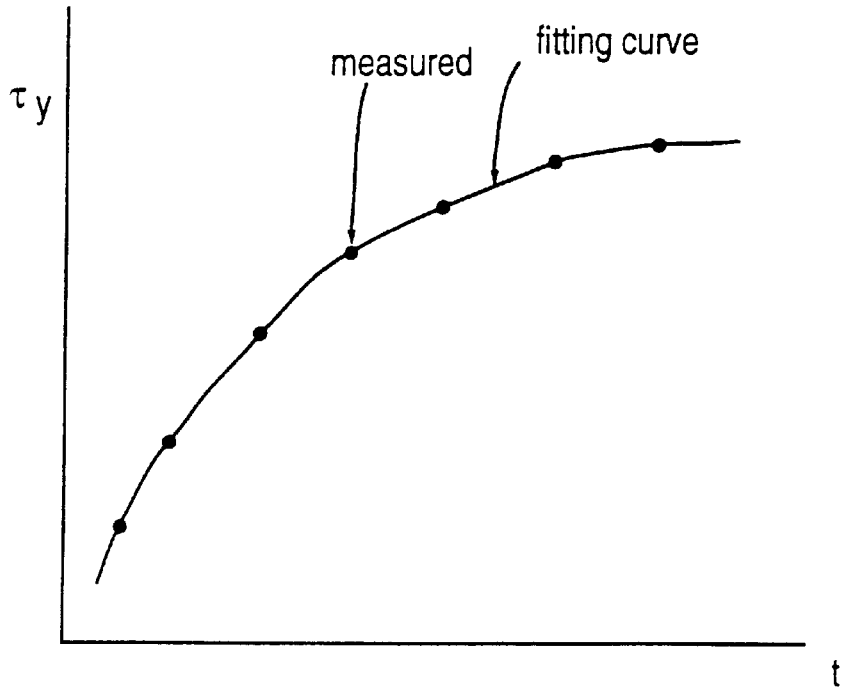

FIG. 4 shows the measured values of drilling fluid yield stress $\tau_y$ as a function of time t, and FIG. 5 shows how these are compared with Equation 1 (above) to permit extraction of the constants A and n.

Figure 6:
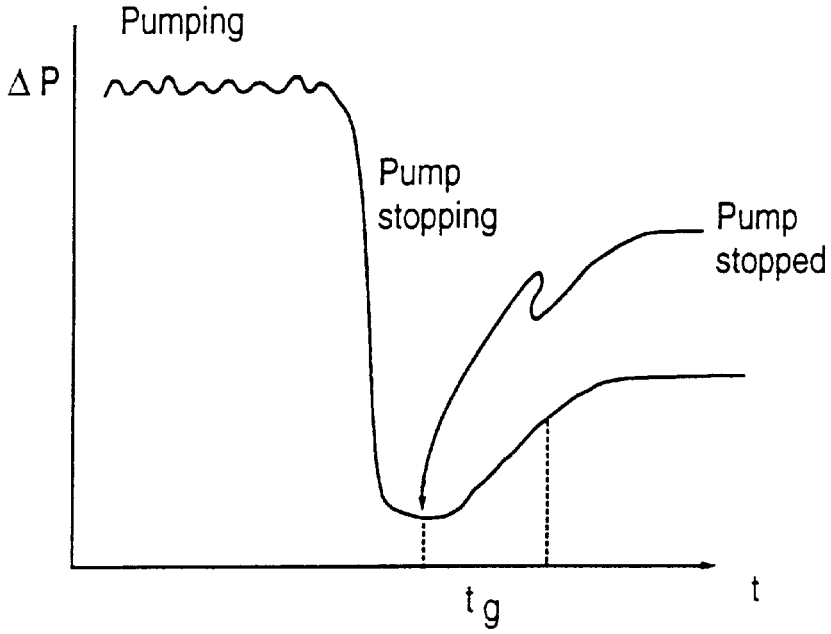
Figure 7:
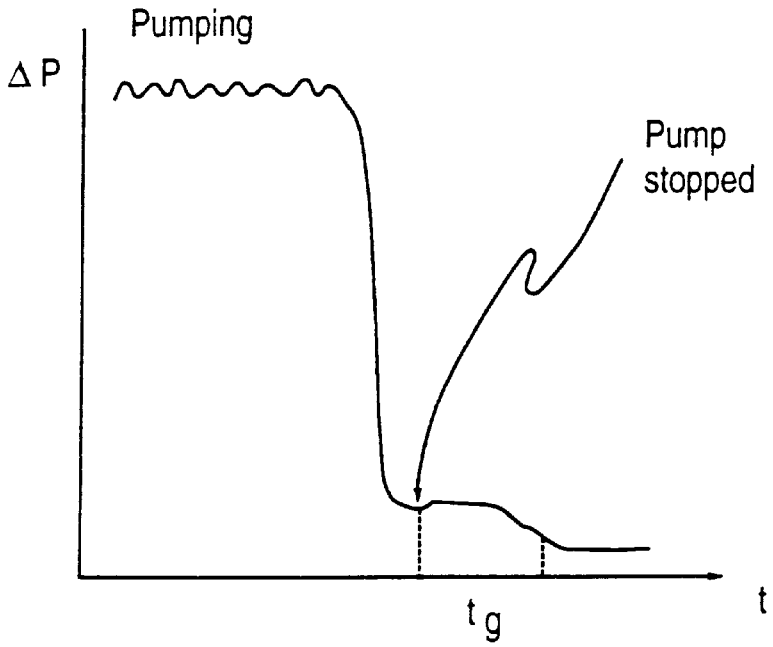

A period of time $t_g$ is needed for gelation to occur, and this is typically about several seconds to several minutes depending on the type of drilling fluid used as well as the downhole temperature and pressure conditions. During this period $t_g$, the differential pressure downhole is measured using the period $t_g$, as seen in FIG. 5, it is determined that there is no influx taking place. If however, the differential pressure ΔP is increasing as shown in FIG. 6, then it is determined that an influx of formation fluids into the borehole is taking place. If, no the contrary, the differential pressure ΔP is decreasing as shown in FIG. 7, then it is determined that a reverse-influx, or efflux, of drilling fluids into the formation is taking place. The detection of an influx condition can trigger an alarm at the surface, prompting the driller to take any required remedial action.

What is claimed is:

1. A method of determining fluid flow into or out of a borehole during drilling of the borehole using a gelling drilling fluid, the method being characterised by including the steps of:

determining the yield stress $\tau_y$ and gelation period $t_g$ of the drilling fluid;

stopping drilling, rotation and pumping, and, while keeping the drilling string stationary for a period of time $t_g$, measuring the downhole differential pressure ΔP between two points spaced along the longitudinal axial orientation of the borehole; and from a knowledge of the yield stress $\tau_y$ and from the observed changes in differential pressure ΔP during the gelation period $t_g$, determining the fluid flow.

2. A method as claimed in claim 1, in which the differential pressure is measured near the bottom end of the bottom hole assembly.

3. A method as claimed in either of claims 1 or 2, in which the differential pressure measurements are recorded in the bottom hole assembly, and are subsequently transmitted to the surface.

4. Apparatus for determining fluid flow into or out of a borehole during drilling of the borehole using a gelling drilling fluid, comprising:

a bottom hole assembly for drilling a borehole;

a differential pressure monitor, affixed to the bottom hole assembly and operative to measure the differential pressure of fluid in the borehole along the longitudinal axial orientation of the borehole;

means for communicating the output of the differential pressure monitor to the surface; and means for determining, responsive to the output of the differential pressure sensor, the borehole fluid influx or efflux, wherein said means for determining fluid influx or efflux comprises means for determining the yield stress, means for determining the gelation period, and means for determining the change in differential pressure of the gelling fluid in the borehole for a period of time at least equal to the gelation period of the gelling fluid.

5. Apparatus as claimed in claim 4, wherein the differential pressure monitor is positioned near the bottom end of the bottom hole assembly.

6. Apparatus as claimed in either of claims 4 or 5, wherein the differential pressure monitor comprises two individual pressure sensors located on the exterior of the bottom hole assembly, and suitably spaced apart from each other along the axial orientation of the borehole.

7. Apparatus as claimed in claim 6, wherein each individual pressure sensor comprises a quartz pressure sensor having a resolution of at least 0.01 psi (60 Pascal) and a range of from 0 to 20 thousand psi.

8. Apparatus as claimed in any of claims 4 or 5, which includes means for recording the differential pressure of the borehole fluid, recording means is located in the bottom hole assembly.

* * * * *